US006273709B1

(12) United States Patent
Potskhishvili et al.

(10) Patent No.: US 6,273,709 B1
(45) **Date of Patent: *Aug. 14, 2001**

(54) GAS LIGHTER WITH SAFETY DEVICE

(76) Inventors: David Vakhtangovich Potskhishvili, B. Gruzinskaya, d. 40, str. 1, kv. 19, Moskva (RU), 123056; Karlo Vakhtangovich Potskhishvili, Gldanskiy massiv II m.r.k.28, kv. 73, Tbilisi (GE), 380038

( * ) Notice: Subject to any disclaimer, the term of this patent is extended or adjusted under 35 U.S.C. 154(b) by 0 days.

This patent is subject to a terminal disclaimer.

(21) Appl. No.: 09/542,250

(22) Filed: Apr. 3, 2000

(51) Int. Cl.[7] ..... F23Q 2/46
(52) U.S. Cl. ..... 431/153; 431/277
(58) Field of Search ..... 431/153, 273, 431/274, 276, 277

(56) References Cited

U.S. PATENT DOCUMENTS 3,963,412 * 6/1976 Chernock ..... 431/273
5,096,414 3/1992 Zellweger ..... 432/277
5,547,370 * 8/1996 Hwang ..... 431/276
6,053,727 * 4/2000 Potskhishvili et al. ..... 431/153

FOREIGN PATENT DOCUMENTS 2304879 3/1997 (GB) .

* cited by examiner

*Primary Examiner*—Sara Clarke
(74) *Attorney, Agent, or Firm*—Jacobson Holman, PLLC

(57) ABSTRACT

A gas lighter includes a gas ignition device having a gearwheel freely and rotatably positioned on a shaft which is rotatably located in openings of body brackets, as well as a flint spring pressed toward the gearwheel. When a finger pad acts on support wheels a spark is prevented from being struck since the gearwheel will not rotate. In order to ignite the gas it is necessary to slightly depress the support wheels so that a portion of the surface of the finger pad contacts the gearwheel. In this case, gearwheel rotation and spark striking occur.

2 Claims, 1 Drawing Sheet

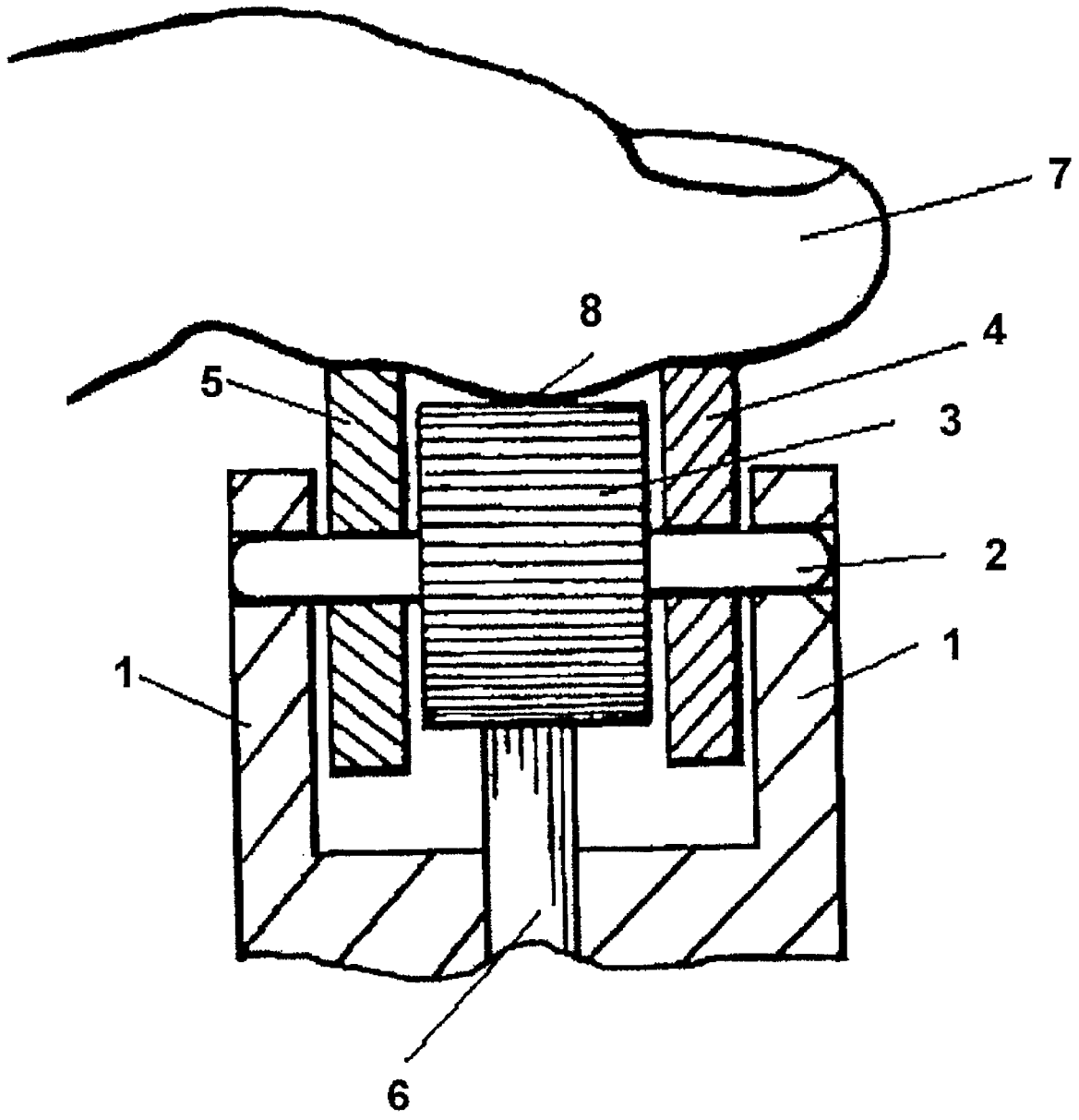
7
8
4
5
3
2
1
1
6

GAS LIGHTER WITH SAFETY DEVICE

BACKGROUND OF THE INVENTION

The present invention relates to the field of energy and is directed to a child-proof gas lighter, i.e. the lighter provided with a means for neutralizing ignition elements being movable between an operating neutralizing position wherein no spark is struck on activating an ignition mechanism, and a position wherein it is possible to produce a spark required to ignite the gas.

A lighter of this type is known which is described in GB, No. A-2304879 in which a gas ignition device includes a gearwheel positioned on a shaft and firmly connected to it, corrugated wheels rotatably positioned on said shaft by sides of the gearwheel to rotate about the shaft and the gearwheel, a flint spring pressed toward the gearwheel, whereby said shaft has side portions on which the corrugated wheels are located and which are formed as a polyhedron, and end portions are cylindrical and disposed in openings of brackets of the lighter body. A maximum diameter of the shaft having a polyhedral cross-section in the area where the corrugated wheels are mounted is less than a minimum diameter of the opening of these wheels.

When the corrugated wheels are classically acted upon, the latter turn about the shaft which precludes striking a spark since the gearwheel will not rotate. To ignite the gas exiting the lighter burner valve, it is necessary to depress the corrugated wheels, to force them into contact with the shaft edges and to turn the wheels in conventional manner. Due to friction occurring when the gearwheels and the shaft interact in the contact area, the shaft and the gearwheel sitting on it can turn.

The described safety devices do not require any additional buttons and lever movements in order to achieve the goal which makes them more attractive as compared to other lighters. The only thing required from a user is to more carefully and with a certain force depress the gearwheels, otherwise they would rotate idly.

However, due to the fact that the gearwheels rotate about the shaft independently of one another, the user not always is able to select the force needed to turn the corrugated wheel. In certain cases, the both gearwheels operate it time but sometimes, only one. Therefore, the user now easily lights the lighter, now with some difficulty. The use of the polyhedral shaft and polyhedral openings in the corrugated wheels increases complexity of producing such a lighter.

A gas lighter is known from U.S. Pat. No. 5,096,414 having a safety device wherein a gas ignition device includes a gearwheel positioned on a shaft and firmly connected to it, corrugated wheels rotatably positioned on said shaft by the sides of the gearwheel to rotate about the shaft and the gearwheel, and a flint spring pressed toward the gearwheel, whereby said shaft is cylindrical and openings in the corrugated wheels are also cylindrical. This lighter is simpler in design and technologically feasible.

When the finger pad acts on the corrugated wheels, the latter freely turn relative to the shaft which prevents from striking a spark since the gearwheel will not rotate. To ignite the gas exiting from the lighter burner valve, it is necessary to slightly depress the corrugated wheels so tat a portion of the finger pad contacts the gearwheel. In this case, gearwheel rotation and spark striking occur. The particular feature of this lighter is the necessity for the finger pad to contact simultaneously all wheels on the shaft.

With all classical lighters, the spark striking device is of an integral design, i.e. the gearwheel and the corrugated wheels, together with the shaft are made as a single non-sectional assembly. This specific feature is absent from the above-mentioned inventions. Here the gearwheel for striking a spark is rigidly linked to the shaft and presents a single non-sectional unit, while the corrugated wheels are separate parts not connected to this unit. When the lighter drops or when it is repaired and assembled, especially under conditions of mass production, there is a risk of losing some parts.

Operational reliability and durability of such a lighter are determined by state of integrity of the lighter or at least its separate units.

Based on the foregoing, it is possible to formulate the requirement compliance with which would allow to enhance the operational features of the gas lighter with such safety device, the requirement consisting in maintaining the technological principle of unit-based construction of the lighter to provide the possibility of its unit-based assembly.

BRIEF DESCRIPTION OF THE INVENTION

The object of the present invention is to provide a gas lighter with reliable protection from children and having the equivalent operational safety and simpler and technologically feasible design.

According to the invention, the desired result is achieved by the fact that the lighter comprises a gas ignition device including a gearwheel freely and rotatably positioned on a shaft that is rotatably disposed in openings of body brackets, support wheels located by the sides of the gearwheel and firmly coupled to the shaft, as well as a flint spring pressed toward a corrugated wheel.

DETAILED DESCRIPTION OF THE DRAWINGS

The present invention is illustrated by the following drawing which represents the preferred embodiment, is not unique but demonstrates the possibility of achieving the desired result provided by totality of essential features as set forth in the claims.

The FIGURE shows the general view of the gas lighter ignition device.

DETAILED DESCRIPTION OF THE INVENTION

According to the present invention, a gas lighter with a safety device designed to prevent children from the possibility of igniting the lighter comprises a gas ignition device which includes a gearwheel freely and rotatably positioned on a shaft rotatably located in openings of body brackets, a flint spring pressed toward the gearwheel as well as support wheels disposed by the sides of the gearwheel and rigidly coupled to the shaft. The support wheels may be both corrugated and with a smooth surface.

Such embodiment of the gas lighter enables, when the finger pad act on the support wheels, to freely turn them together with the shaft relative to the gearwheel which eliminates striking a spark since the gearwheel, disengaged from the shaft, will not rotate. In order to ignite the gas, it is necessary to slightly depress the support wheels so that a portion of the surface of the finger pad contact the gearwheel. In this case, rotation of the gearwheel and spark striking occur.

A specific example of implementing the present invention is discussed below.

By a gas lighter within the scope of the present invention is meant a classical lighter having, generally, an extended elongate body being a receptacle for liquefied gas and which is provided, in its upper part and integral with the body, with two brackets 1 having openings in which shaft 2 with gearwheel 3 placed thereupon is rotatably mounted. From one end of the brackets, in the body the burner valve is secured linked to a control lever that is pivotally fixed in the brackets below the axis of the shaft 2 (not shown). The shaft has smooth or corrugated support wheels 4 and 5 secured to it and located by the sides of the gearwheel 3. Under the gearwheel, in the body a passage is formed for receiving a spring which presses flint 6 against the geared surface of wheel 3. Generally, in most known designs of such type of lighters, the passage for the spring and flint is formed along the body. Design of such lighter is schematically shown in the figure.

According to the present invention, the gas lighter with safety device designed to prevent the possibility of children igniting the lighter comprises the gas ignition device with a gearwheel 3 secured on the shaft 2 that is rotatably mounted in the openings (the figure) of the body brackets 1. Gearwheel 3 is mounted on the shaft 2 to freely turn relative to said shaft. Support wheels 4 and 5 are firmly coupled to this shaft 2.

Thus it can be seen that the lighter according to the invention is an integral construction of units coupled therebetween one of which is the ignition unit. Because the support wheels are rigidly connected to the shaft, the gearwheel positioned between them is also in a fixed position. When the lighter drops or is disassembled, this unit does not fall apart into separate parts as it takes place in the closest prior art.

The gas lighter according to the invention is operated as follows.

When the finger pad 7 acts on the support wheels, the latter turn freely with the shaft relative to the gearwheels which prevents a spark from being stuck so that the gearwheel does not rotate. To ignite the gas, it is necessary to slightly depress the support wheels so that a portion 8 of the finger pad contact gearwheel 3. In this case, rotation of the gearwheel 3 on the shaft 2 and spark striking occur. When the support wheels are corrugated, interaction between the finger and the gearwheel is enhanced, whereby the lighter has the same appearance as the classical lighter due to which the function of safety device is disguised. When the support wheels are made smooth, while maintaining the function of supporting the finger, the process of manufacturing the lighter is simplified due to eliminating the step of corrugating the wheels 4 and 5.

The present invention makes it possible to improve technological feasibility of the lighter and its reliability as to safety of its use.

We claim:

1. A gas lighter with safety device intended to prevent the possibility of children igniting the lighter, comprising:

body brackets, a shaft rotatable located in openings of the body brackets, a gas ignition device including a gearwheel positioned on the shaft rotatably located in the openings of the body brackets, a flint spring pressed toward the gearwheel, support wheels located on the shaft by sides of the gearwheel, the gearwheel being rotatably mounted on the shaft while the support wheels are rigidly coupled to the shaft.

2. The gas lighter with safety device of claim 1, wherein said support wheels are corrugated.

* * * * *